United States Patent [19]

Jones et al.

[11] Patent Number: 4,790,361

[45] Date of Patent: Dec. 13, 1988

[54] COLLAPSIBLE CARBONATED BEVERAGE CONTAINER

[75] Inventors: David T. S. Jones; Gareth W. Jones, both of Westminster, S.C.

[73] Assignee: Containers Unlimited, Westminster, S.C.

[21] Appl. No.: 890,399

[22] Filed: Jul. 25, 1986

[51] Int. Cl.[4] ..... B65D 1/40; B65D 23/00

[52] U.S. Cl. ..... 150/55; 215/1 C; 215/12.1; 220/72

[58] Field of Search ..... 150/55; 222/92, 95, 222/107, 215; 138/121; 215/1 C, 12 R; 72/59; 220/72; 229/90

[56] References Cited

U.S. PATENT DOCUMENTS

| | | | |
|---|---|---|---|
| Re. 32,379 | 3/1987 | Touzani | 215/1 C |
| 687,790 | 12/1901 | Scales | 222/92 |
| 972,095 | 10/1910 | Booth | 222/92 |
| 2,009,761 | 7/1935 | Calderara | 215/1 C |
| 2,129,120 | 9/1938 | Davis | 72/59 |
| 2,250,022 | 7/1941 | Hoffman | 222/92 |
| 2,268,993 | 1/1942 | Sanders | 215/1 C |
| 3,083,877 | 4/1963 | Gash | 150/55 X |
| 3,872,994 | 3/1975 | Hyde | 215/1 C X |
| 3,918,603 | 11/1975 | Hatada | 215/1 C X |
| 3,946,903 | 3/1976 | Parker | 222/92 |
| 4,079,757 | 3/1978 | Fischer et al. | 138/121 |
| 4,270,589 | 6/1981 | Heinzl | 150/55 |
| 4,456,134 | 6/1984 | Cooper | 215/12 R |
| 4,492,313 | 1/1985 | Touzani | 150/55 X |
| 4,610,366 | 9/1986 | Estes et al. | 215/1 C |

FOREIGN PATENT DOCUMENTS

| | | | |
|---|---|---|---|
| 2042593 | 3/1972 | Fed. Rep. of Germany | 150/55 |

*Primary Examiner*—Stephen Marcus
*Assistant Examiner*—Sue A. Weaver
*Attorney, Agent, or Firm*—Jones, Askew & Lunsford

[57] ABSTRACT

A collapsible carbonated beverage container is formed with a plurality of collapsible corrugations which allow collapse of the container. The corrugations include planar regions which provide a surface for attachment of a label, and which serve as a "hinge" about which the corrugations collapse after the contents have been removed. The structure of the corrugations provides axial stability to prevent flopping-over. After liquid is removed from the container, the container is axially collapsed and the top resealed, thereby preserving carbonation in the beverage.

19 Claims, 4 Drawing Sheets

COLLAPSIBLE CARBONATED BEVERAGE CONTAINER

TECHNICAL FIELD

The present invention relates generally to collapsible containers, and more specifically relates to a collapsible container for carbonated beverages such as soft drinks and the like which resists axial bending yet still collapses as the contents of the container are removed to preserve carbonation.

BACKGROUND

Carbonated beverages are currently stored in a variety of sizes and shapes of containers, including traditional glass bottles, metal cans, and, more recently, large plastic containers. Carbonation in the beverage is sufficiently retained so long as the container remains sealed. Once a container has been opened, however, carbonation rapidly escapes even if a container is reclosable. When most of the carbonation has escaped from the beverage, the beverage becomes "flat" and is undesirable for consumption.

Resealable caps are frequently employed on larger soft drink containers so as to preserve carbonation. However, the beverage still tends to lose carbonation even when recapped. The loss of carbonation has been attributed to the volume of air trapped within the container above the surface of the beverage. Because of the principle of dynamic equilibrium of liquid to vapor, carbonation in a beverage diminishes in proportion to the surface area of the beverage exposed to the air as well as the effective volume of air above the surface. While capping the bottle with a sealing device such as a cap or stopper may retard the loss of carbonation, carbonated beverages still tend to lose carbonation if the container is repeatedly opened and reclosed.

Various types of collapsible containers are known in the art. For example, U.S. Pat. No. 3,946,903 discloses a collapsible, spirally fluted container for dispensing viscous material. It is not believed that this container would be suitable for soft drinks since the amount of plastic material required to create the spiral flutes would make the container inordinately expensive and therefore undesirable. Many various types of collapsible containers for viscous materials are known in the art, for example U.S. Pat. Nos. 2,268,993, 2,250,022, 2,129,120, 2,009,761, 972,095, and 687,790. While these types of collapsible containers are quite suitable for thick, viscous materials such as paint, toothpaste, cold cream, and the like, many of these containers are made from metal and are thus inappropriate for soft drinks, or are susceptible to axial tilting. For example, soft drink containers must be able to stand upright. Containers designed for viscous materials typically are not designed to stand upright and consequently should the container be filled with a fluid material instead of a viscous material, the container would have a tendency to "flop" over, which would be undesirable.

Accordingly, there is a need for an improved collapsible container for carbonated beverages such as soft drinks which does not suffer from these problems in prior art collapsible containers.

SUMMARY OF THE INVENTION

The present invention overcomes these and other problems in prior art collapsible containers by providing an improved collapsible container. The container is able to stand upright, and provides a surface for application of a label which signifies the contents of the container. Briefly summarized, the present invention comprises a container body having one closed end and a second open end for receiving a removable cap. Means are defined on the outside surface of the container body for allowing the collapse of the body as the contents of the container are removed. Furthermore, means are provided for preventing axial tilt of the body of the container as the contents are removed, so that the container tends to remain upright. Advantageously, the container may be collapsed after the contents are removed and the cap replaced, providing but a small volume of air and a reduced surface area of the beverage exposed to air, to retard loss of carbonation.

More particularly described, the container body is formed with a plurality of collapsible corrugations formed in the body. In a preferred embodiment, each of the corrugations comprises a ridge and a pair of oppositely disposed grooves which extend circumferentially about the body. The ridge comprises a plurality of planar regions which extend generally parallel to the axis of the body. These first planar regions provide a surface for attachment of a label, and these regions serve as a "hinge" about which the container collapses as the contents are removed. The corrugations further comprise a plurality of second planar regions adjacent to and extending from the sides of the first planar regions toward the groove. These second planar regions provide strength to the container and define the ridges. When the body of a container is axially collapsed after some of the contents have been removed, the first planar regions tend to be forced radially outwardly as the second planar regions pivot about the first planar region, which serves as the hinge for collapsing.

A number of advantages are derived from the structure of the present invention. The container is able to store a conventional amount of soft drink, such as, for example, 2 to 4 liters, while still maintaining the ability to stand upright. The cap may be repeatedly removed, and the container collapsed as the contents are removed, yet the beverage contained therein will retain its carbonation due to the diminished volume of air above the exposed surface of the liquid, as well as the diminished surface area of the liquid. The container resists breakage due to the high strength of a plastic material used to form the container. The container is easy to grasp and pour, since the corrugations provide a firm grip for a person holding the container. The container may be manufactured by conventional blowmolding techniques, using commercially available plastic materials presently used to form carbonated beverage containers. The structure of the pleated regions on the corrugations provides a suitable area for secure attachment of the label identifying the contents. Additionally, the air space under the label and between the ridges in the corrugations may help insulate the container and the contents thereof. Finally, and not in the least insignificantly, the collapsible aspect of the containers reduces the transportation cost of the containers from the manufacturing to the bottling plant, since the containers may be collapsed after manufacture, shipped to a bottling plant, and expanded as the contents are placed into the container. Therefore, approximately twice as many of the collapsed containers may be packed into a transportation container than conventional plastic soft drink containers.

Accordingly, it is an object of the present invention to provide an improved collapsible carbonated beverage container.

It is another object of the present invention to provide a collapsible carbonated beverage container which maintains axial stability when the container is full.

It is another object of the present invention to provide an improved collapsible soft drink container which provides a surface for secure attachment of a label identifying the contents of the container.

It is another object of the present invention to provide an improved collapsible beverage container which may be manufactured with conventional materials and by conventional manufacturing techniques.

It is another object of the present invention to provide an improved beverage container which may be more economically transported from the point of manufacture to a bottling plant.

It is another object of the present invention to provide an improved carbonated beverage container which extends the life of the beverage contents by retarding loss of carbonation even after repeated openings and closings of the container.

These and other objects, features, and advantages of the present invention may be more clearly understood and appreciated from a review of the following detailed description of the disclosed embodiments and by reference to the appended drawings and claims.

BRIEF DESCRIPTION OF THE DRAWINGS

FIG. 4A is a front perspective view of the preferred embodiment illustrated in FIG. 1, in the collapsed configuration, while

DETAILED DESCRIPTION OF THE DISCLOSED EMBODIMENTS

Figure 1:
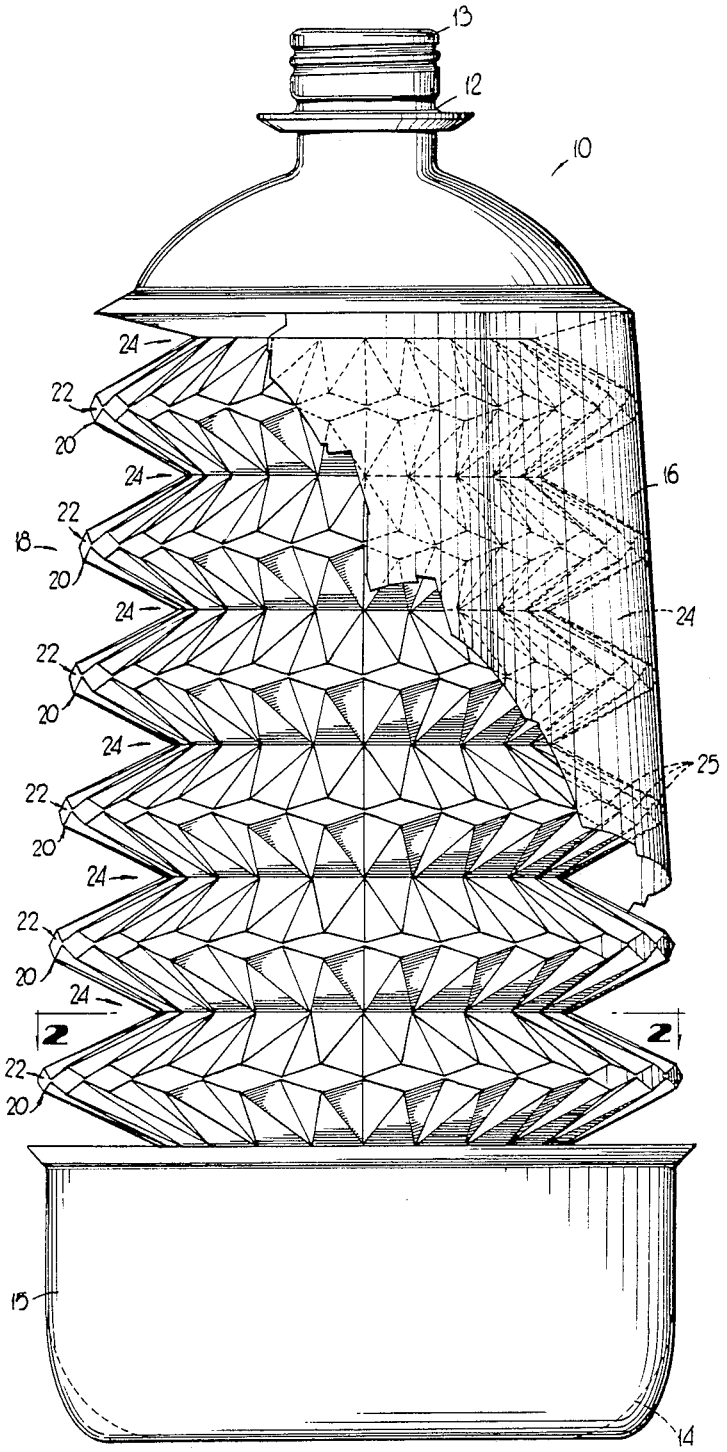
FIG. 1 is a front perspective view of the collapsible carbonated beverage container constructed according to the preferred embodiment.

Referring now to the drawings, in which like numerals indicate like elements throughout the several views, FIG. 1 shows a preferred embodiment of a collapsible carbonated beverage container 10 constructed in accordance with the present invention. The container 10 comprises an upper end 12, which is threaded for receiving a removable and resealable cap 13. The bottom 14 of the container is generally rounded, and is glued to a plastic base 15. A label 16, which is shown partially removed from the container, is wrapped around the container and identifies the contents. The body 18 of the container, positioned between the upper end 12 and bottom end 14, comprises a plurality of corrugations 20 which allow the container to collapse. In the preferred embodiment illustrated in FIG. 1, each of the corrugations comprises a ridge 22 and groove 24 separating the ridges.

Figure 3:
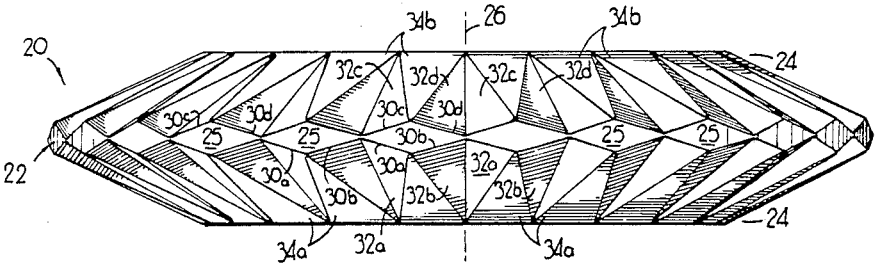
FIG. 3 is a detailed front view of one of the corrugations of the preferred embodiment illustrated in FIG. 1.

As more particularly illustrated in FIG. 3, the ridge 22 of each corrugation comprises a first planar region 25 which is oriented substantially parallel to the vertical axis 26 of the container. In the preferred embodiment, the first planar regions 25 are quadrilaterals. The first planar regions provide a surface area to which the label is applied and glued.

As seen in FIG. 3, each of the first planar regions 25 in the preferred embodiment has four sides 30*a*–30*d*. Extending from the bottom two sides 30*a*, 30*b* are a pair of second planar regions 32*a*, 32*b*, respectively, which extend downwardly from the first planar region toward the groove 24. Similarly, second planar regions 32*c*, 32*d* extend upwardly from the sides 30*c*, 30*d*, respectively, toward the oppositely-disposed groove 24. Each of the second planar regions 32*a*, 32*b*, 32*c* and 32*d* are generally triangular in the preferred embodiment, having a base coinciding with the sides 30*a*, 30*b*, 30*c*, and 30*d* of the first planar region 25, and having an apex coinciding with its respective groove 24.

Disposed between adjacent second planar regions 32*a*, 32*b*, 32*c* and 32*d* are third planar regions 34*a*, 34*b*, 34*c* and 34*d*, for example, the triangular region 34*a* which is disposed between the triangular second planar regions 32*a*, 32*b*. Each third planar region 34*a*, 34*b*, 34*c* and 34*d* has a base coinciding with the groove 24, and an apex adjacent the intersection between the sides 30*a*, 30*b* of the first planar region 25.

It will therefore be appreciated that the first planar region 25, the second planar regions 32*a*, 32*b*, 32*c* and 32*d*, and the third planar regions 34*a*, 34*b*, 34*c* and 34*d* form a plurality of facets, with the first planar region 25 located at the ridge of a given corrugation and the base of a third planar region 34*a*, 34*b*, 34*c* and 34*d* terminated adjacent the grooves 24 on either side of the ridge 22.

Figure 2:
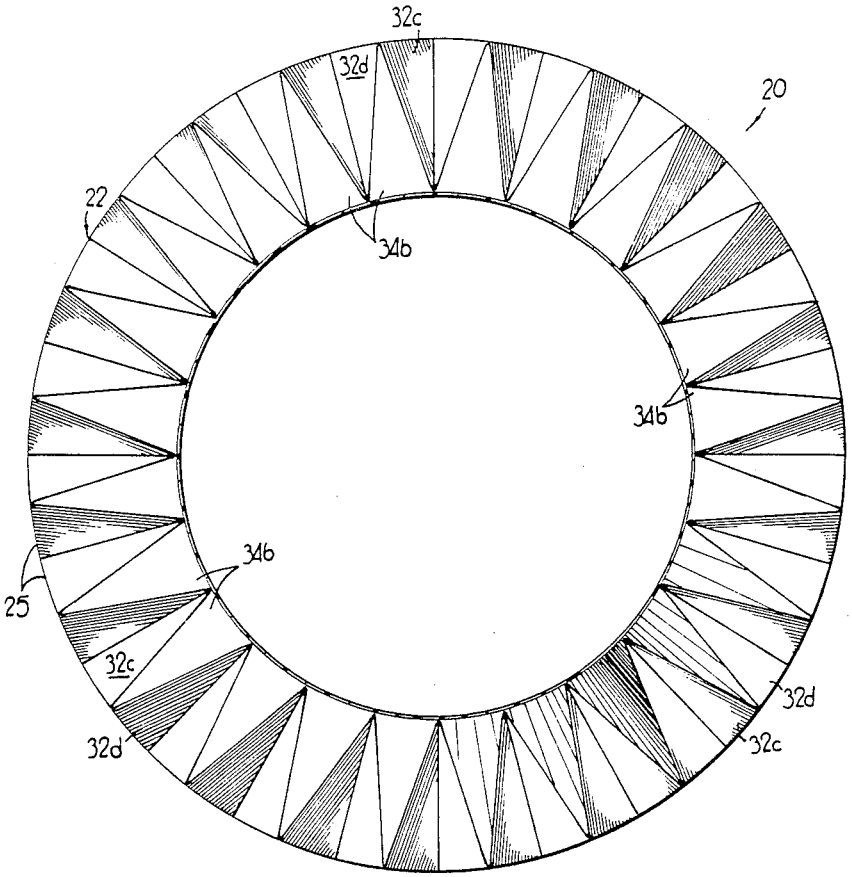
FIG. 2 is a cross-sectional view of the container illustrated in FIG. 1, taken along the line 2—2 of FIG. 1.

The plurality of the facets can also be seen in relation to each other as shown in FIG. 2.

Figure 4A:
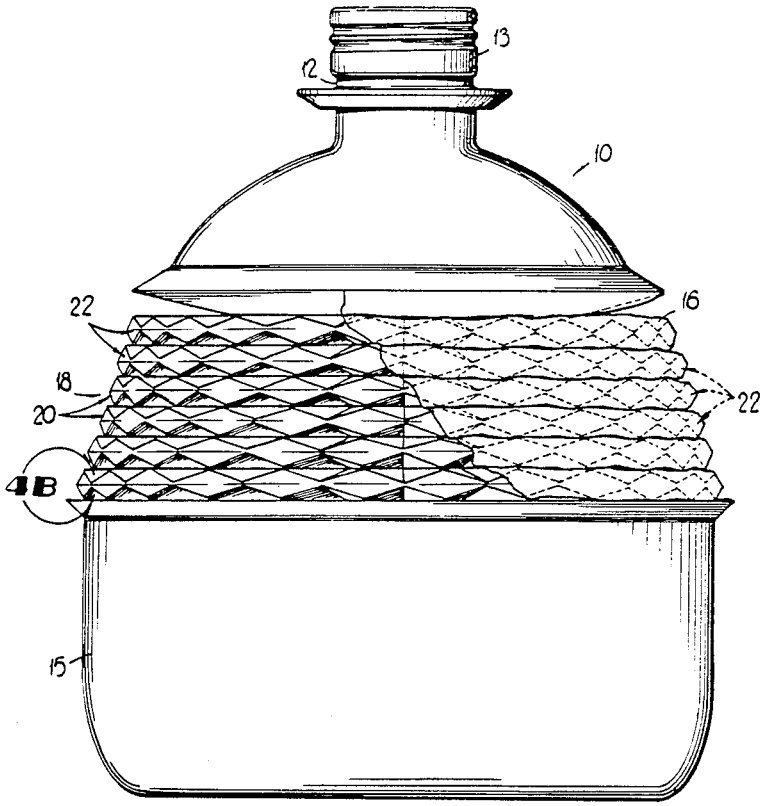
Figure 4B:
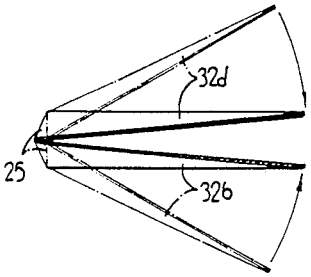
FIG. 4B is a detailed partial schematic view illustrating the movement of the elements shown at 4B in FIG. 4A.
Figure 6:
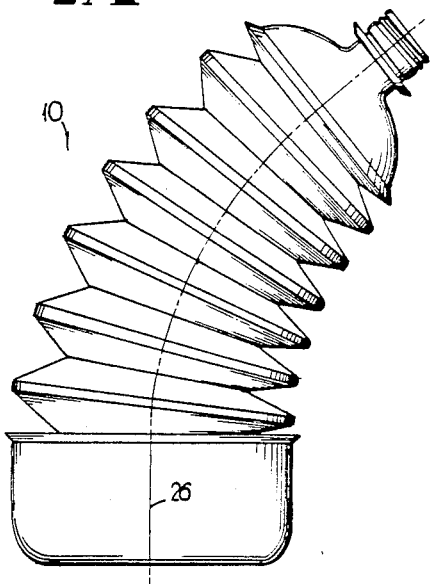
FIG. 6 illustrates the axial tilt of a container which is limited by the present invention.
Figure 5A:
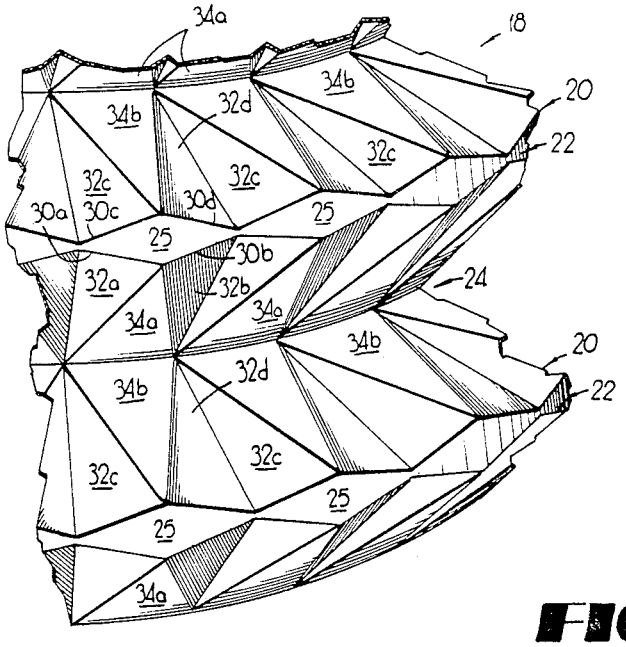
FIG. 5, consisting of FIGS. 5A and 5B, are detailed partial perspective views of the corrugations of the preferred embodiment of FIG. 1 in the expanded and collapsed configurations, respectively.
Figure 5B:
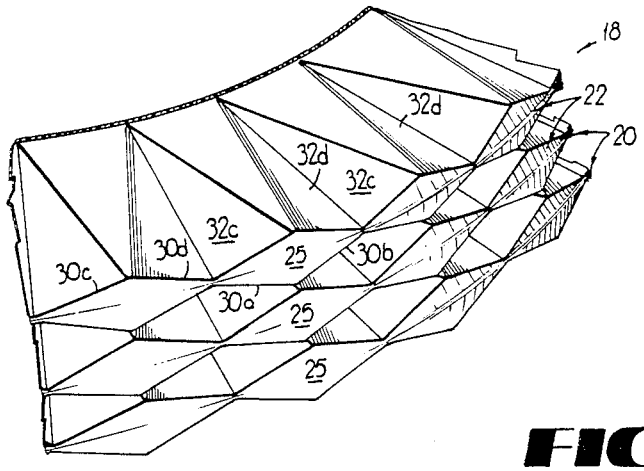

After the contents are removed from the container 10, the container may be collapsed by exerting inward axial pressure on the container. The label 16 being made of flexible plastic provides little resistance to the collapsing. As the container is collapsed, the faceted regions comprising the second planar regions 32*a*, 32*b*, 32*c* and 32*d* and third planar regions 34*a*, 34*b*, 34*c* and 34*d* move inwardly toward each other on the interior of the container. The quadrilateral or first planar region 25 serves as a "hinge" about which the second 32*a*, 32*b*, 32*c* and 32*d* and third 34*a*, 34*b*, 34*c* and 34*d* planar regions pivot, as more clearly shown in the expanded region in FIG. 4. The quadrilateral regions 25 tend to bow outwardly instead of crease, thereby maintaining the structural strength and integrity of the entire container. The combination of the label 16, being glued to the first planar regions 25, together with the structural stability imparted by the second and third planar regions 32*a*, 32*b*, 32*c* and 32*d* and 34*a*, 34*b*, 34*c* and 34*d*, prevents tilting or "flop over" in excess of that illustrated in FIG. 5. Due to the thinness of the plastic material after molding, it is believed that a conventional accordion-type pleating structure will result in flopping-over of the container when full. Additionally, a conventional accordion-type pleat will not provide a suitable area for attachment of the label. Preferably, the angle between oppositely-disposed second planar regions 32*b*, 32*d* is approximately 60° in the preferred embodiment, although it will be understood that different angles may also be suitably operative. Preferably, the container possesses a slight taper from the lowermost corrugation 20 adjacent to the bottom end 14 of the container 10 to the uppermost corrugation 20 adjacent to the upper end 12 of the container, preferably approximately 4°, as shown best in FIG. 1.

The container is manufactured by blow-molding with a polypropylene material having a medium molecular weight, preferably a polypropylene material having the same molecular weight as that currently used in polypropylene bottles for the containment of soft drinks. Polypropylene of this type has sufficient stiffness and resilience to force the container to the uncollapsed configuration when empty. The container is molded by first forming a parison in a parison mold with a predetermined amount of polymerized polypropylene. The parison is removed from the parison mold and placed into a blow mold. Compressed air forces the parison to assume the detailed structure of the collapsible container as described hereinabove. Finally, the base, if employed, is glued to the bottom of the container, the container is filled and capped, and a label is attached thereto.

Additional advantages resulting from the structure of the present invention may now be understood and appreciated. The label adheres securely to the facet regions of the corrugations 20, and especially to the quadrilateral regions 25, adding stability to the container. Additionally, the air space beneath the label and in the region of the grooves 24 provides a degree of insulation for the contents of the container. Of course, the paper or plastic label provides little resistance to collapse of the bottle in the axial direction, since the label being glued to the surface of the pleats or corrugations only inhibits flop-over because of its tensile strength.

In use, the contents may be poured from the container in the manner of a conventional soft drink bottle. The user then presses the upper end 12 of the container toward the bottom end 14, causing gradual collapse under hand pressure. Preferably, the user halts the collapse when the liquid level has reached the area immediately beneath the top lip, so as to provide an absolute minimum air volume above the top surface of the liquid. The cap 13 is replaced and fastened securely to seal the container. If the seal is not secure, air will seep into the container and the container will tend to expand, signalling the consumer that the cap is not securely fastened.

Advantageously, the facets hold the inner circumference of the pleated sections in the area of the grooves 24 constant at all levels. This allows for expansion of the outer circumference of the pleated section in the vicinity of the first planar regions 25 to permit controlled collapse. The facets furthermore resist compression of the outer circumference to resist stretching beyond the desired standing height, inasmuch as excessive expansion would tend to cause the second planar regions 32*a*, 32*b*, 32*c* and 34*d* to bow inwardly. Since the first planar regions 25 do not readily compress, upward stretch beyond the molded full height is restricted. After such stretching, and on release, the container will resume its molded height due to the resilience of the material from which the container is molded.

It will by now be understood that the present invention, when incorporated in a container for soft drinks and the like, can be fabricated to contain the usual amount of soft drink preferred by marketers and consumers, namely 2 to 4 liters, without difficulty. The container will stand vertically in a cooler or refrigerator and not tend to flop-over. The container is easy to handle and grasp, since the corrugations provide a convenient gripping surface. The shape is not markedly different from conventional soft drink containers, so that resistance by consumers to the shape of container should not be encountered. Of course, and most importantly, the carbonation of the beverage can be retained even to the last servings by tightly replacing the cap after a serving has been poured and the container has been collapsed.

Moreover, due to the collapsible nature of the container, the containers may be collapsed for shipping from the molding facility to the bottling plant, thereby allowing greater efficiencies in transportation of the empty bottles. As a natural follow on, the containers may be collapsed when emptied of its contents by consumers, thereby occupying less trash space and facilitating disposal.

Finally, the preferred embodiment of the present invention has been disclosed by way of example, and it will be understood that other modifications may occur to those skilled in the art without departing from the scope and the spirit of the appended claims.

We claim:

1. An improved soft drink container, comprising: a generally cylindrical container body having one closed end and a second open end for receiving a removable cap;

corrugation means defined on said container body for allowing axial collapse of said body, said corrugation means defining a plurality of ridges and grooves; and means for retarding axial tilt of said body comprising a plurality of separate first planar regions located on each of said ridges, said first planar regions having sides, each of said first planar regions extending generally parallel to the axis of said container body, and a plurality of second planar regions adjacent to and extending from said sides of said first planar regions toward said grooves, whereby the container may be collapsed as the contents thereof are removed while still maintaining the ability of the container to sit upright.

2. The container of claim 1, wherein said retarding means provides a surface for application of a label.

3. The container of claim 1, wherein said retarding means retards axial expansion of said container body.

4. An improved collapsible container for carbonated beverages and the like, comprising:

a generally cylindrical body having one closed end and a second open end for receiving a removable cap;

a plurality of collapsible annular corrugations formed in said body, each of said corrugations comprising a ridge and a pair of grooves, said ridge comprising a plurality of separate first planar regions having sides extending generally parallel to the axis of said body, and a plurality of separate second planar regions adjacent to and extending from the sides of said first planar regions toward said grooves, whereby when said body is axially collapsed, said first planar regions tend to be forced radially outwardly.

5. The container of claim 4, wherein said first planar regions are lozenge shaped, and said second planar regions are triangular shaped.

6. The container of claim 4, wherein said first planar regions are quadrilaterals, and wherein said second planar regions are triangles.

7. The container of claim 4, further comprising a plurality of third planar regions positioned between a pair of said second planar regions disposed on the same side of said ridge.

8. The container of claim 4, wherein said first planar regions provide a surface for application of a label.

9. An improved collapsible container for carbonated beverages and the like, comprising:

a generally cylindrical body formed of resilient material and having one closed end and a second open end for receiving a removable cap, and a plurality of collapsible annular corrugations formed in said body, each of said corrugations comprising a ridge and a pair of grooves, said ridge comprising a plurality of quadrilateral regions extending generally parallel to the axis of said body, four first triangular regions adjacent to the sides of each of said quadrilateral regions and having apices adjacent said grooves, and a pair of second triangular regions disposed between two of said first triangular regions on the same side of each of said ridges, each of said second triangular regions having a base adjacent to a groove and an apex adjacent to an intersection of two sides of said quadrilateral region, whereby when said body is axially collapsed, said quadrilateral regions tend to bend along an axis generally aligned with the circumference of said ridge and are forced radially outwardly.

10. The container of claim 9, wherein said quadrilateral regions provide a surface for attachment of a label for said container.

11. An improved soft drink container, comprising:

a container body having one closed end and a second open end for receiving a removable cap;

corrugation means comprising a plurality of parallel annular ridges and grooves defined on said container body for allowing axial collapse of said body; and means for retarding axial tilt of said body, said retarding means comprising:

a plurality of first planar regions located on said ridges extending generally parallel to the axis of said container body;

a plurality of second planar regions adjacent to and extending from the sides of said first planar regions toward said grooves;

each of said first planar regions comprising a quadrilateral region extending generally parallel to the axis of said body;

each of said second planar regions comprising a first triangular region adjacent to each side of said quadrilateral region and having apices adjacent said grooves; and a second triangular region disposed between a pair of said first triangular regions on the same side of said ridges, each of said second triangular regions having a base adjacent to a groove and an apex adjacent to an intersection of two sides of said quadrilateral region, whereby the container may be collapsed as the contents thereof are removed while still maintaining the ability of the container to sit upright.

12. An improved collapsible container for carbonated beverages and the like, comprising:

a generally cylindrical body having one closed end and a second open end for receiving a removable cap;

a plurality of collapsible annular corrugations formed in said body, each of said corrugations comprising a ridge and a pair of grooves, said ridge comprising a plurality of first lozenge shaped planar regions extending generally parallel to the axis of said body, and a plurality of triangular shaped second planar regions adjacent to and extending from the sides of said first planar regions toward said grooves, whereby when said body is axially collapsed, said first planar regions tend to be forced radially outwardly.

13. An improved collapsible container for carbonated beverages and the like, comprising:

a generally cylindrical body having one closed end and a second open end for receiving a removable cap;

a plurality of collapsible annular corrugations formed in said body, each of said corrugations comprising a ridge and a pair of grooves, said ridge comprising a plurality of first quadrilateral planar regions extending generally parallel to the axis of said body, and a plurality of triangular second planar regions adjacent to and extending from the sides of said first planar regions toward said grooves, whereby when said body is axially collapsed, said first planar regions tend to be forced radially outwardly.

14. An improved collapsible container for carbonated beverages and the like, comprising:

a generally cylindrical body having one closed end and a second open end for receiving a removable cap;

a plurality of collapsible annular corrugations formed in said body, each of said corrugations comprising a ridge and a pair of grooves, said ridge comprising a plurality of first planar regions having sides exending generally parallel to the axis of said body, a plurality of second planar regions adjacent to and extending from the sides of said first planar regions toward said grooves; and a plurality of third planar regions positioned between a pair of said second planar regions disposed on the same side of said ridge, whereby when said body is axially collapsed, said first planar regions tend to be forced radially outwardly.

15. An improved soft drink container, comprising:

a container body having one closed end and a second open end for receiving a removable cap;

corrugation means defined on said container body for allowing axial collapse of said body, said corrugation means comprising a plurality of annular ridges and grooves; and a plurality of separate first planar regions having sides located along said ridges and having an elongate portion extending generally parallel to the axis of said container body and having a narrow portion connecting adjacent ones of said first planar regions along a circumference of said container body, said planar regions tending to bend radially outwardly when said container body is collapsed but limiting axial expansion of said container body.

16. The container of claim 15, further comprising a plurality of separate second planar regions adjacent to and extending from said sides of said first planar regions toward said grooves.

17. The container of claim 16, wherein said first planar regions are quadrilaterals, and wherein said second planar regions are triangular shaped.

18. The container of claim 15, wherein said first planar regions are quadrilaterals.

19. the container of claim 18, wherein said quadrilaterals are generally lozenge shaped.

* * * * *